US005996998A

United States Patent [19]

Przybilla

[11] Patent Number: 5,996,998

[45] Date of Patent: Dec. 7, 1999

[54] SPHERICAL TOPS

[76] Inventor: Kurt Przybilla, 84 Withers St. 4th Floor, Brooklyn, N.Y. 11211

[21] Appl. No.: 09/079,475

[22] Filed: May 15, 1998

[51] Int. Cl.[6] ..... A63F 9/16; A63H 1/00

[52] U.S. Cl. ..... 273/147; 446/256

[58] Field of Search ..... 273/147, 146, 273/274; 434/281, 278, 277, 213; 446/256, 257, 264, 126

[56] References Cited

U.S. PATENT DOCUMENTS

| | | | |
|---|---|---|---|
| 547,764 | 10/1895 | Boyum | 446/256 |
| 655,621 | 8/1900 | Gustine | 446/257 |
| 809,293 | 1/1906 | Friedenthal | 273/146 |
| 2,151,030 | 3/1939 | Hinson | 273/146 |
| 2,573,916 | 11/1951 | Loveday | 273/147 |
| 2,633,664 | 4/1953 | Neilson | 446/257 |
| 4,121,831 | 10/1978 | Greene | 273/160 |
| 4,635,938 | 1/1987 | Gray | 273/274 |
| 5,645,464 | 7/1997 | Chen | 446/120 |

*Primary Examiner*—Benjamin H. Layno
*Attorney, Agent, or Firm*—Goldstein & Canino

[57] ABSTRACT

A spinning top system, comprising a plurality of spheres, each sphere having a center. The spinning top are arranged according to one of several geometric formations, including a tetrahedron, octahedron, icosahedron, cube octahedron, and a hexagon, each of said geometric formations having several vertices. The spheres of the spinning top are arranged according to the particular geometric formation, wherein each vertice of the geometric formation corresponds to the center of one of the spheres. Arranging the spheres in this manner creates an symmetrical spinning top, which is capable of balancing and spinning upon one of these spheres. The spinning tops are also capable of stacking to form a stack of considerable height.

13 Claims, 4 Drawing Sheets

SPHERICAL TOPS

CROSS REFERENCES AND RELATED SUBJECT MATTER

This application relates to subject matter contained in provisional patent application Ser. No. 60/064,190, filed in the United States Patent and Trademark Office on Nov. 4, 1997.

BACKGROUND OF THE INVENTION

The invention relates to a sphere based symmetrical spinning top system. More particularly, the invention relates to a system of spinning tops which are constructed by closely packing identical spheres in the configuration of various three-dimensional polyhedrons.

A spinning top can be the source of both amazement and education for children and adults alike. The common spinning top can be challenging to get into motion, mesmerizing to watch, and interesting to learn the principles behind it's behavior. Principles of balance, centripetal force, and gyroscopic principles are all readily visualized by observing and playing with a spinning top.

A solid sphere is symmetrical. That is, the sphere can balance on any point on its outer surface. A hollow sphere can balance equally well if the outer "skin" is of uniform thickness.

A polyhedron will easily rest in equilibrium on any given side surface. In theory, many symmetrical polyhedra could balance on any vertice. Although it would defy logic to see a cube, a tetrahedron, or even an icosahedron statically resting on a single point, it is theoretically possible. In general, an object will balance in equilibrium upon a surface, when the object is fully symmetrical at that point of contact. In reality, however, external forces and imprecision in manufacturing make a static equilibrium upon a single vertice impossible as a practical matter. Thus, although the symmetrical property of these polyhedra can be mathematically proven, it is still quite difficult to demonstrate.

SUMMARY OF THE INVENTION

It is an object of the invention to produce a spinning top which is constructed of identical spheres. The spheres are generally joined in a close packing configuration. Additionally, the top can be molded, so that it is outwardly shaped like a close packing of spheres, but it is actually a single molded piece article of manufacture. Thus, the internal spaces within the spherical formation are filled in to maintain the same symmetrical properties as the close packing configuration.

It is another object of the invention to produce a spinning top which demonstrates the symmetrical characteristics of various polyhedra. The spheres are joined so as to simulate the polyhedra. The center of each sphere simulates one of the vertices of the polyhedra. Spinning the top on one of the spheres counteracts external forces and manufacturing imprecisions, and allows the top to balance upon one of the spheres as long as the top continues to spin.

It is a further object of the invention to provide a series of tops, constructed from four or more spheres, in different geometric configurations, to act as an educational aid in teaching about the geometric shapes, and about the physical laws that govern the motion thereof.

It is a still further object of the invention to provide a plurality of tops, and to demonstrate the stackability of the tops.

The invention is a spinning top system, comprising a plurality of spheres, each sphere having a center. The spinning top are arranged according to one of several geometric formations, including a tetrahedron, octahedron, icosahedron, cube octahedron, and a hexagon, each of said geometric formations having several vertices. The spheres of the spinning top are arranged according to the particular geometric formation, wherein each vertice of the geometric formation corresponds to the center of one of the spheres. Arranging the spheres in this manner creates an symmetrical spinning top, which is capable of balancing and spinning upon one of these spheres. The spinning tops are also capable of stacking to form a stack of considerable height.

To the accomplishment of the above and related objects the invention may be embodied in the form illustrated in the accompanying drawings. Attention is called to the fact, however, that the drawings are illustrative only. Variations are contemplated as being part of the invention, limited only by the scope of the claims.

BRIEF DESCRIPTION OF THE DRAWINGS

In the drawings, like elements are depicted by like reference numerals. The drawings are briefly described as follows.

DETAILED DESCRIPTION OF THE PREFERRED EMBODIMENTS

Figure 1:
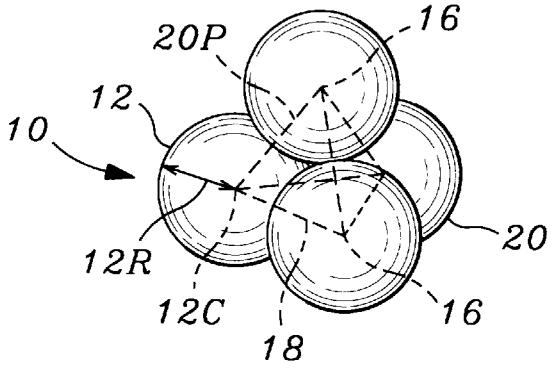
FIG. 1 is a diagrammatic perspective view, illustrating a spinning top, configured as a tetrahedral top.

FIG. 1 illustrates a spinning top 10, comprised of spheres 12, each having a center 12C, and a radius 12R. The spheres are of uniform size. Illustrated in FIG. 1 is a tetrahedral configuration 20 for the spinning top 10. The tetrahedral configuration 20 is based upon a tetrahedron 20P which is superimposed in phantom upon the spheres in FIG. 1.

The tetrahedron 20P has four vertices 16 and six edges 18. The center 12C of each sphere 12 corresponds to one of the vertices 16. At least one sphere 12 is present for each of the vertices 16. The tetrahedral configuration 20 is formed by closely packing the four spheres. Thus, each edge 18 is equal in length to twice the radius 12R.

Figure 2:
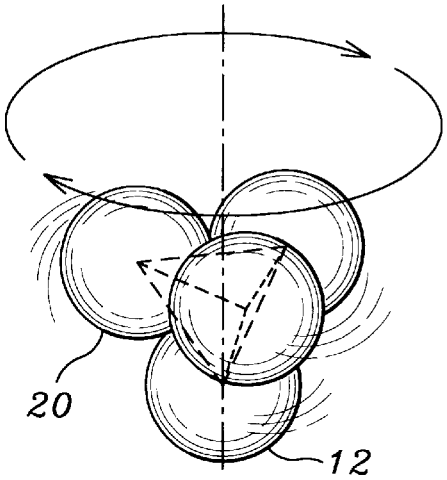
FIG. 2 is a diagrammatic perspective view of the tetrahedral top in motion.

FIG. 2 illustrates the tetrahedral configuration spinning top 20 in motion. While spinning, the tetrahedral top 20 rests on a single sphere 12. Because of the omnisymmetry of the tetrahedron 20P and the resulting top, and the counteraction of external forces by the spinning motion, balance upon a single sphere 12 is possible. Thus, by spinning the top 20 it is possible to demonstrate that an symmetrical geometric form can balance upon a single sphere.

The top will remain balanced upon one sphere until the spinning slows and the forces generated by the spinning can no longer counteract external forces and make up for manufacturing imprecision in the spheres and top.

Figure 3:
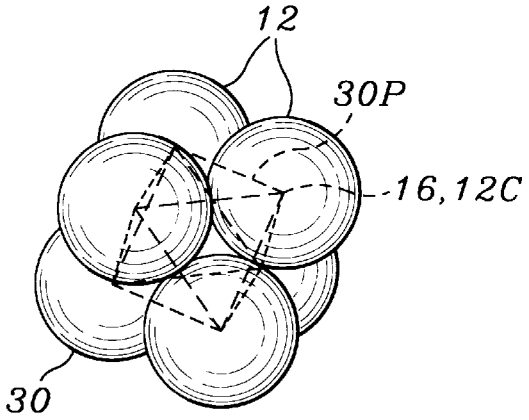
FIG. 3 is a diagrammatic perspective view, illustrating the spinning top configured as an octahedral top.
Figure 4:
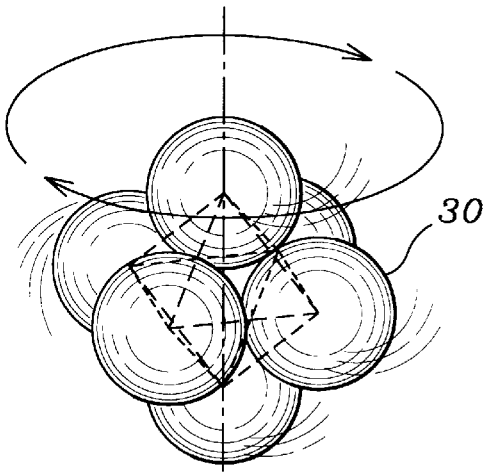
FIG. 4 is a diagrammatic perspective view, illustrating the octahedral top in motion.

FIG. 3 illustrates the spinning top in an octahedral top 30 configuration. The octahedral top 30 comprises six spheres 12 superimposed on an octahedron 30P, with the sphere centers 12C corresponding to the vertices 16 of the octahedron 30P. FIG. 4 illustrates the octahedral top 30 in motion.

Figure 5:
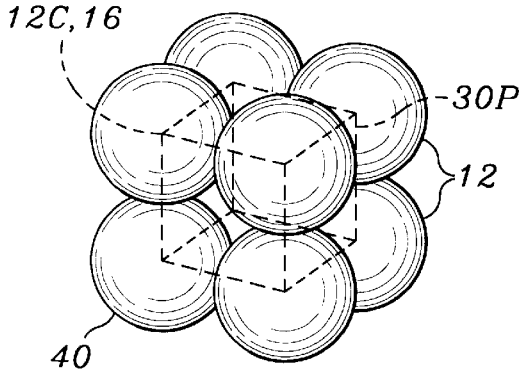
FIG. 5 is a diagrammatic perspective view, illustrating the spinning top configured as a cubic top.
Figure 6:
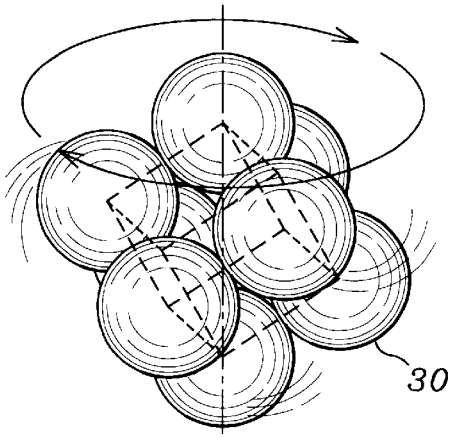
FIG. 6 is a diagrammatic perspective view, illustrating the cubic top in motion.

FIG. 5 illustrates the spinning top in a cubic top 40 configuration. The cubic top 40 comprises eight spheres 12 superimposed on a cube 40P, with the sphere centers 12C corresponding to the vertices 16 of the cube 40P. FIG. 6 illustrates the cubic top 40 in motion.

Figure 7:
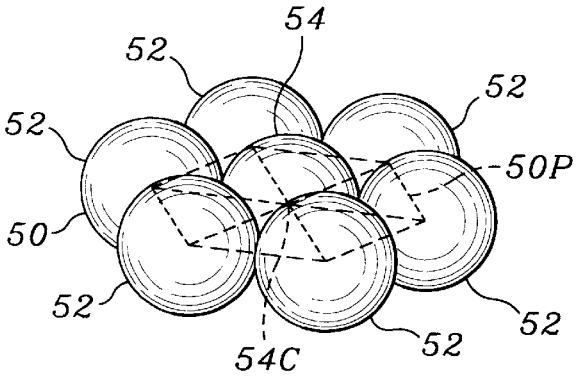
FIG. 7 is a diagrammatic perspective view, illustrating the spinning top configured as a planar top.

FIG. 7 illustrates a planar top 50. The planar top 50 is comprised of a close packing of six outer spheres 52 around a center sphere 54. The center sphere 54 has a center sphere center 54C. Connecting the centers of the outer spheres 52 creates a hexagon 50P, illustrated in phantom. Connecting the centers of the each of the outer spheres 52 with the center 54C of the inner sphere 54 creates six adjacent equilateral triangles within the hexagon. The center of the six outer spheres 52 and the center sphere 54 lie in a common plane. This arrangement of seven spheres to form the planar top 50 is the only possible planar configuration around a single sphere, since a hexagon is the only regular polygon which contains equilateral triangles. Only arrangements of equilateral triangles can be formed with a close packing of spheres as long as the spheres all have the same radius.

Figure 8:
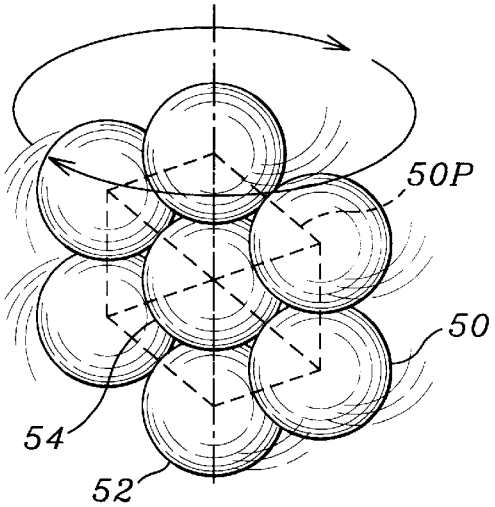
FIG. 8 is a diagrammatic perspective view, illustrating the planar top in motion.

FIG. 8 illustrates the planar top 50 in motion. The planar top 50 is spun upon any one of the outer spheres 52, with the center sphere 54 directly above. Thus, when the common plane extends vertically, the planar top 50 can balance on any one of the outer spheres 52. Although the hexagon polygon 50P that the planar top 50 is based upon is merely a two-dimensional polygon rather than three dimensional like the polyhedrons previously described, the inherent symmetry of the individual spheres creates a three-dimensional weight balance that allows the planar top 50 to be balanced upon a vertices of the hexagon polygon 50P as it is spun.

Figure 9:
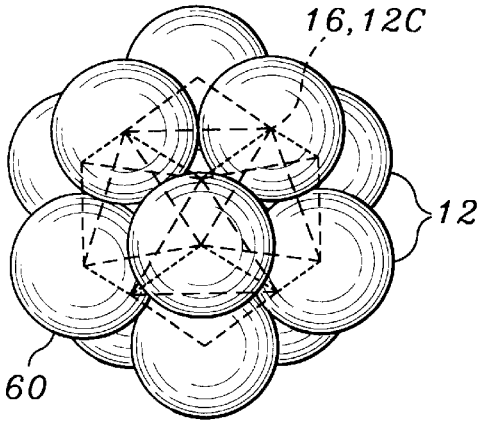
FIG. 9 is a diagrammatic perspective view, illustrating the spinning top configured as an icosahedral top.
Figure 10:
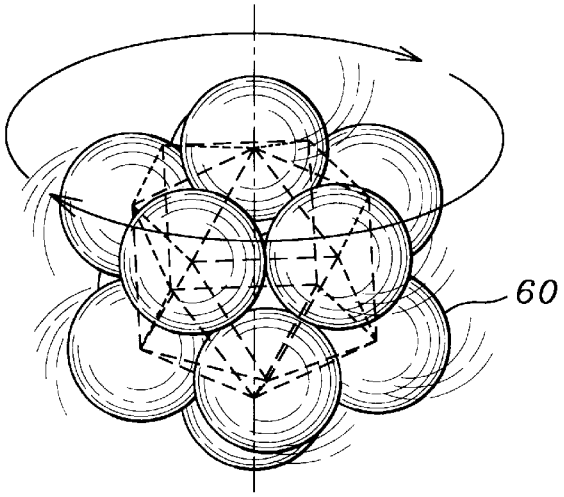
FIG. 10 is a diagrammatic perspective view, illustrating the icosahedral top in motion.

FIG. 9 illustrates the spinning top in an icosahedral top 60 configuration. The icosahedral top 60 comprises twelve spheres 12. The center 12C of each sphere represent a vertice 16 of an icosahedron 60P. FIG. 10 illustrates the icosahedral top 60 in motion.

Figure 11:
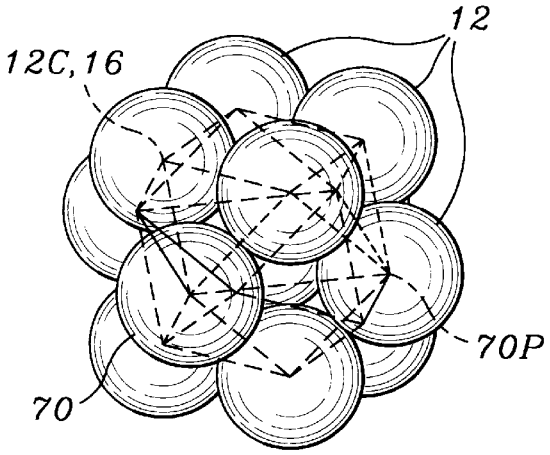
FIG. 11 is a diagrammatic perspective view, illustrating the spinning top configured as a cubic-octahedral top.
Figure 12:
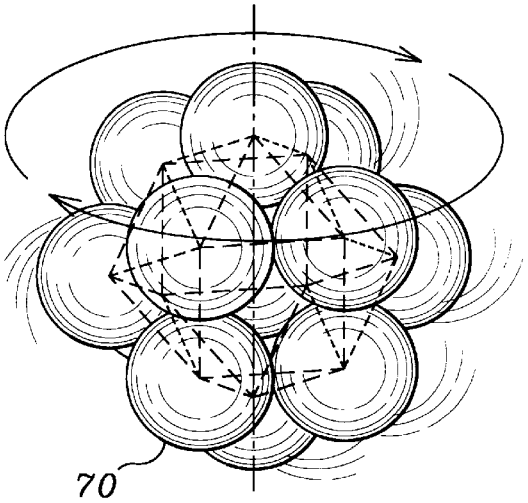
FIG. 12 is a diagrammatic perspective view, illustrating the cubic-octahedral top in motion.

FIG. 11 illustrates the spinning top in a cubic-octahedral top 70 configuration. The cubic-octahedral top 70 comprises thirteen spheres 12. The center 12C of one of the spheres represents the center of the cubic-octahedral top 70. The center 12C of each of the remaining twelve spheres 12 represents a vertice 16 of a cubic octahedron 70P. FIG. 12 illustrates the cubic-octahedral top 70 in motion.

Figure 13:
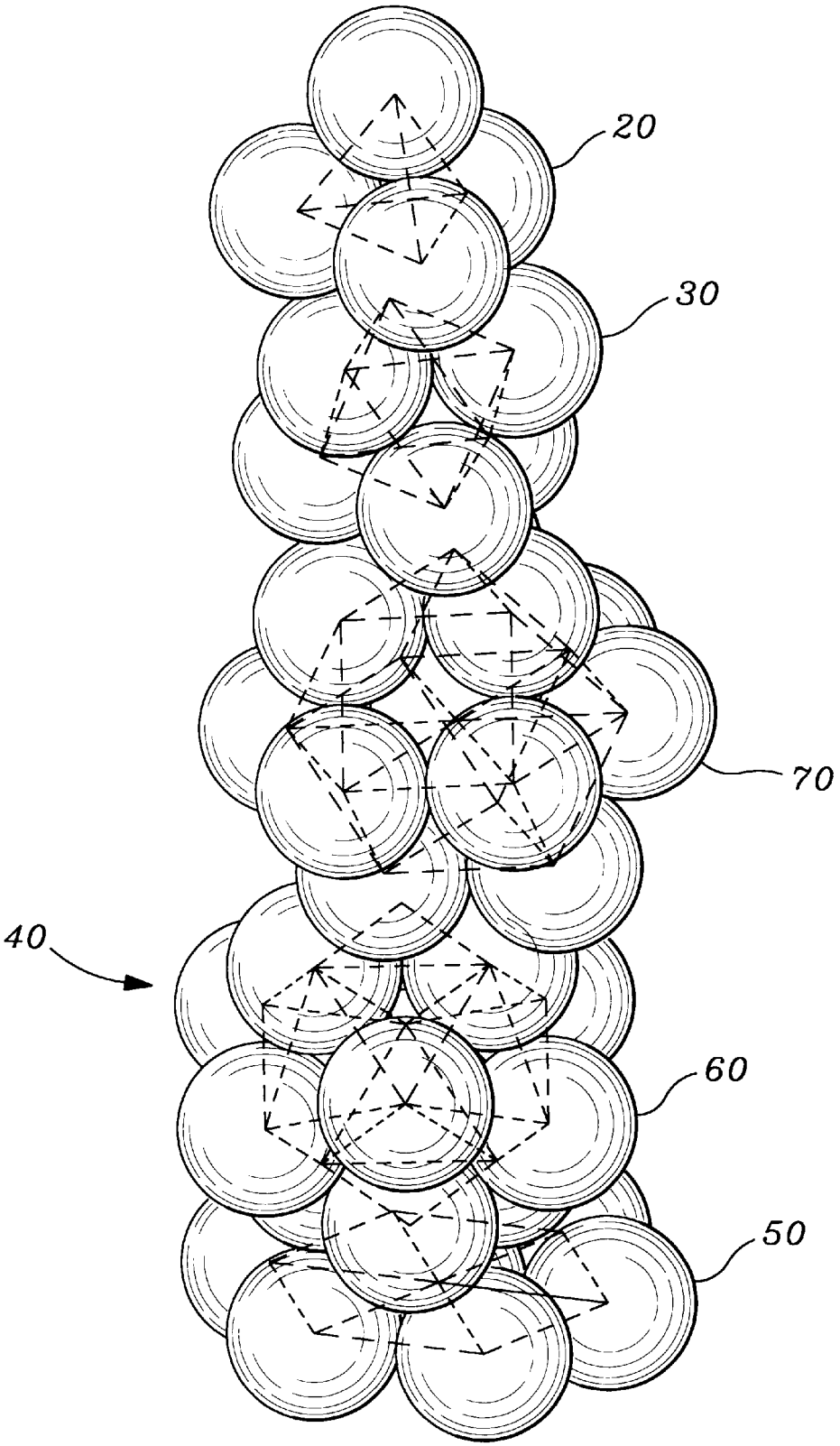
FIG. 13 is a diagrammatic perspective view, illustrating several different configurations for the spinning top, stacked in a tower arrangement.

FIG. 13 illustrates a stack 90 comprised of different configurations of the spinning top. Illustrated in the stack 90 are the planar top 50, the icosahedral top 60, the cubic-octahedral top 70, the octahedral top 30, and the tetrahedron top 20. The symmetrical nature of these tops allows the stack 90 to be created with considerable height. The stack thus created has an unusual appearance, since the sphere-based tops create the appearance of being more unstable than the demonstration actually proves.

It is important to note that the various tops may be constructed by assembling a close packing of individual spheres. However, the tops can also be molded in a single piece, wherein the top has an outward appearance and symmetry like the close packing configuration, but the internal spaces between the spheres are filled in, to make the top compatible with current molding technology. It should be noted however, that various molding techniques available for molding the present invention would be apparent to those skilled in the art, and as such the particular manufacturing technique for the tops is beyond the scope of this discussion.

In conclusion, herein is presented a system of spinning tops which are based upon a combination of spheres arranged in an symmetrical geometric formation.

What is claimed is:

1. A spinning top, comprising:

a plurality of spheres, each sphere having a sphere center, the spheres attached to each other and positioned according to an symmetrical polygon having a plurality of vertices, wherein the number of spheres is at least equal to the number of vertices in the polygon, the spheres are arranged so that the center of each sphere is located at one of the vertices of the polygon, the spheres having no numbered indicia.

2. The spinning top as recited in claim 1, wherein the polygon is a three dimensional polyhedron.

3. The spinning top as recited in claim 2, wherein the polyhedron is selected from the group consisting of a tetrahedron, octahedron, cube, icosahedron, and cubic octachedron.

4. The spinning top as recited in claim 1, wherein the polygon is a hexagon, wherein the spheres comprise six outer spheres which are arranged such that the centers of all spheres lie in a common plane and the centers of each said outer sphere corresponds with one of the vertices of the hexagon, and the spheres further comprise a center sphere that is surrounded by the outer spheres such that the centers of any two adjacent outer spheres forms an equilateral triangle with the centers of the center sphere, so that the top will balance on any one of the spheres when the common plane extends vertically.

5. A spinning top method, using a spinning top having an outward appearance based upon an arrangement of a plurality of spheres each having a center, arranged according to a symmetrical polygon having a plurality of vertices, each vertice located at one of the sphere centers, comprising the steps of:

placing the spinning top on a surface with one of the spheres contacting the surface;

rotating the top around the sphere in contact with the surface;

allowing the top to spin on the sphere whereby the rotation of the top counteracts external forces and allows the top to balance on the sphere in contact with the surface.

6. The spinning top method as recited in claim 5, wherein the polygon is an symmetrical polyhedron.

7. The spinning top method as recited in claim 6, wherein the polyhedron is selected from the group consisting of a tetrahedron, cube, octahedron, icosahedron, and cubic octachedron.

8. The spinning top method as recited in claim 5, wherein the polygon is a hexagon, wherein the spheres comprise six outer spheres which are arranged such that the centers of all spheres lie in a common plane and the centers of each outer sphere corresponds with one of the vertices of the hexagon, and the spheres further comprise a center sphere surrounded by the outer spheres, such that the centers of any two adjacent outer spheres forms an equilateral triangle with the center of the center sphere, so that the spinning top will balance on any one of the outer spheres when the common plane extends vertically.

9. The spinning top method as recited in claim 5, employing a second spinning top made of a plurality of spheres arranged according to an symmetrical polygon, wherein the method further comprises the step of:

resting the original spinning top on a surface; and stacking the second spinning top on the spinning top by balancing one of the spheres of the second spinning top on the original spinning top.

10. A spinning top, comprising:

a formation having the outward appearance of a plurality of spheres, each sphere having a sphere center, the spheres attached to each other and positioned according to an symmetrical polygon having a plurality of vertices, wherein the number of spheres is at least equal to the number of vertices in the polygon, the spheres are arranged so that the center of each sphere is located at one of the vertices of the polygon, the spheres having no numbered indicia.

11. The spinning top as recited in claim 10, wherein the polygon is a three dimensional polyhedron.

12. The spinning top as recited in claim 11, wherein the polyhedron is selected from the group consisting of a tetrahedron, cube, octahedron, icosahedron, and cubic octachedron.

13. The spinning top as recited in claim 12, wherein the polygon is a hexagon, wherein the spheres comprise six outer spheres which are arranged such that the centers of all spheres lie in a common plane and the centers of each said outer sphere corresponds with one of the vertices of the hexagon, and the spheres further comprise a center sphere that is surrounded by the outer spheres such that the centers of any two adjacent outer spheres forms an equilateral triangle with the centers of the center sphere, so that the top will balance on any one of the spheres when the common plane extends vertically.

* * * * *